US005298058A

United States Patent [19]

Matsui et al.

[11] Patent Number: 5,298,058

[45] Date of Patent: Mar. 29, 1994

[54] ELECTROLESS COPPER PLATING BATH

[75] Inventors: Fujio Matsui; Yasuyuki Yamamoto, both of Tokyo, Japan

[73] Assignee: C. Uyemura & Co., Ltd., Osaka, Japan

[21] Appl. No.: 982,892

[22] Filed: Nov. 30, 1992

[30] Foreign Application Priority Data

Nov. 28, 1991 [JP] Japan ..... 3-339954

[51] Int. Cl.[5] ..... C23C 18/40

[52] U.S. Cl. ..... 106/1.23; 106/1.26

[58] Field of Search ..... 106/1.18, 1.23, 1.26

[56] References Cited

U.S. PATENT DOCUMENTS 2,965,551 12/1960 Richaud ..... 106/1.22
3,615,736 10/1971 Stone ..... 106/1.26
4,482,596 11/1984 Gulla et al. ..... 106/1.23

*Primary Examiner*—Helene Klemanski
*Attorney, Agent, or Firm*—Sughrue, Mion, Zinn, Macpeak & Seas

[57] ABSTRACT

An electroless copper plating bath comprises a water soluble copper salt, a complexing agent, and a reducing agent consisting of phosphorous acid or a phosphite. As compared with conventional acidic bath using hypophosphorous acid, the bath is less expensive while depositing a uniform copper film at equivalent efficiency.

4 Claims, 1 Drawing Sheet

ELECTROLESS COPPER PLATING BATH

FIELD OF THE INVENTION

This invention relates to an electroless copper plating bath adapted particularly for depositing copper films on plastics and non-conductive materials for forming electromagnetic shield layers thereon.

BACKGROUND OF THE INVENTION

It is well known in the prior art to form copper deposits on plastics and non-conductive materials for providing electromagnetic shield layers thereon. In general, parts which require electromagnetic shield layers to be formed thereon are relatively large in size. Then electroless copper plating techniques are often used for forming copper deposits since uniform deposits can be formed even on such large size parts. More illustratively, copper deposits are formed on plastics and non-conductive materials in accordance with conventional chemical plating techniques by effecting suitable pretreatments such as degreasing and etching, forming metallic palladium or silver nuclei on the surface of non-conductive material for activation and then performing chemical copper plating.

As is well known in the art, better electromagnetic shields are manufactured by paying up an electroless nickel deposit on an electroless copper deposit for protecting the copper deposit against oxidation which would otherwise detract from shielding effect.

In the manufacture of such electromagnetic shields, the electroless copper plating process uses a bath containing a water soluble salt of copper, a complexing agent and a reducing agent, which is typically formalin. However, since the electroless copper plating bath containing formalin as a reducing agent is an alkaline bath due to the inclusion of formalin, it is sometimes difficult to apply to some types of non-conductive material which should be shielded against electromagnetic radiation.

In such cases, an acidic or neutral bath containing hypophosphorous acid or a salt thereof as the reducing agent would be useful. Unfortunately, hypophosphorous acid and salts thereof are relatively expensive chemicals. For electromagnetic shield manufacture which often involves processing of relatively large size parts over relatively large surface areas, an increase in processing cost due to the use of expensive chemicals becomes non-negligible.

Therefore, it is desired to have an electroless copper plating bath of the acidic type capable of forming copper deposits at a cost as low as possible.

SUMMARY OF THE INVENTION

The inventors have discovered that phosphorous acid or a salt thereof is effective as the reducing agent for an electroless copper plating bath. More particularly, in an electroless copper plating bath containing a water soluble salt of copper, a complexing agent and a reducing agent, we used as the reducing agent phosphorous acid or a salt thereof which is less expensive than the hypophosphites used in the prior art. Carrying out electroless copper plating with this bath, we found unexpectedly that a uniform copper deposit was obtained at substantially the same efficiency as from the hypophosphite-containing bath.

Further, the bath containing phosphorous acid or a salt thereof as the sole reducing agent is excellently stable.

Accordingly, the present invention provides an electroless copper bath comprising a water soluble salt of copper, a complexing agent, and a reducing agent consisting of phosphorous acid or a phosphite.

BRIEF DESCRIPTION OF THE DRAWING

The only figure.

DETAILED DESCRIPTION OF THE INVENTION

Figure 1:
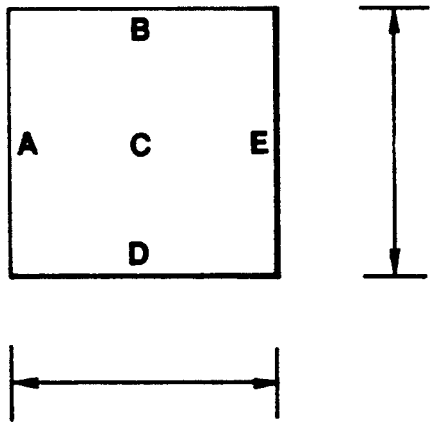
FIG. 1 is a plan view of a square sample having a copper deposit formed in Example 2, showing locations at which deposit thickness is measured for determining the distribution of deposit thickness.

The present invention is concerned with an electroless copper plating bath comprising a water soluble salt of copper, a complexing agent, and a reducing agent consisting of phosphorous acid or a phosphite in water. The water soluble copper salts used herein are preferably cupric sulfate, cupric chloride and other salts yielding divalent copper ions. Preferably the copper salts are added to the bath in a concentration of about 0.02 to about 0.1 mol/liter, especially about 0.04 to about 0.06 mol/liter.

The complexing agent may be selected from well-known ones, for example, organic carboxylic acids such as acetic acid, lactic acid, citric acid, malic acid, tartaric acid and salts thereof, thioglycolic acid and salts thereof, ammonia, glycine and salts thereof, and mixtures thereof. The complexing agent should preferably be present in an at least equimolar amount to the copper salt, more preferably in an amount of about 2 to about 10 mol per mol of the copper salt.

The electroless copper plating bath of the invention contains phosphorous acid or a phosphite as the sole reducing agent. The phosphites used herein include sodium phosphite and potassium phosphite and the like. The reducing agent should preferably be present at a concentration of about 0.02 to about 0.2 mol/liter, more preferably about 0.08 to about 0.12 mol/liter.

The phosphorous acid and phosphite used as the reducing agent are less expensive than the hypophosphites commonly used in conventional acidic type electroless copper plating baths. Therefore the present invention reduces the cost of electroless copper plating procedure. As previously mentioned, in the application of electromagnetic shields on non-conductive materials, electroless copper deposits are often further coated with electroless nickel deposits. The electroless nickel plating step uses a bath containing a reducing agent in the form of hypophosphorous acid or a salt thereof. As nickel plating proceeds, the hypophosphites are oxidized into phosphites which can be recovered and reused in the electroless copper plating bath of the present invention. This recycle system contributes to a more cost reduction.

If desired, the electroless copper plating bath of the invention may contain pH adjusting agents, buffer agents, stabilizers, and other additives. The bath is often at pH 4 to 9, especially at pH 4 to 6.

The electroless copper plating bath of the invention is used in the same manner as the conventional electroless copper plating bath. A workpiece to be plated is pretreated in a conventional manner and then dipped in the bath typically at a temperature of from room temperature to 80° C., especially 40° to 60° C. The plating time may be suitably chosen depending on a desired deposit thickness and the rate of deposition.

Japanese Patent Application No. 70647/1990 by C. Uyemura Co., Ltd. discloses a method for forming a shield layer on a workpiece by dipping the workpiece and an anode in an electroless copper plating bath, and conducting electric current between the workpiece serving as the cathode and the anode, thereby continuously effecting electroless copper plating and electrolytic copper plating on the workpiece at the same time. The electroless copper plating bath of the present invention is also advantageously applicable to this concurrent electroless and electrolytic copper plating method for forming a copper deposit.

More specifically, the nonconductive workpiece is pretreated by conventional techniques to form metallic palladium or silver nuclei on the surface of the nonconductive workpiece and then dipped in the electroless copper plating of the present invention while conducting electric current between the nucleated workpiece (cathode) and an anode such as copper or an insoluble anode including platinum, platinum-plated titanium, titanium, carbon and the like, thereby continuously effecting electroless copper plating and electrolytic copper plating at the same time. In this case, the cathodic current density is preferably be in the range of about 0.01 to about 1 A/dm$^2$. More preferably, the electrolytic copper plating is conducted at a cathodic current density of about 0.1 A/dm$^2$ or less and then the cathodic current density is raised to 0.1 to 1 A/dm$^2$.

Any desired workpiece can be plated in the bath of the present invention. Preferred workpieces include plastic moldings, printed wiring board substrates and ceramic bodies which have been suitably pretreated in a conventional manner. The bath of the present invention is advantageously used for forming electromagnetic shields on non-conductive materials such as plastic moldings. The workpieces are pretreated by conventional techniques, for example, degreasing, water washing, etching, pickling, activating, accelerating and the like, such that the surface of the workpieces to be plated is ready for accepting metallic palladium or silver nuclei.

After a copper deposit is chemically formed on a non-conductive material using the electroless copper plating bath according to the present invention, a nickel or chromium deposit can be further applied onto the copper deposit. In the case of electroless nickel plating, hypophosphorous acid or hypophosphite is typically used as the reducing agent and is converted into phosphorous acid or phosphite with the progress of plating. The resulting phosphorous acid or phosphite may be recovered and reused as the reducing agent in the electroless copper plating bath of the present invention.

EXAMPLE

Examples of the present invention are given below by way of illustration and not by way of limitation.

EXAMPLE 1

An acrylonitrile-butadiene-styrene (ABS) resin plate of 30×30×3 mm was degreased and etched in accordance with conventional techniques and then formed on the surface with metallic palladium nuclei. The pretreatment steps used herein are shown below together with parameters thereof.

| | | |
|---|---|---|
| (1) Degreasing | cleaner conditioner CD-102* 2.5 vol % | 65° C./5 min. |
| (2) Washing | warm water | 50° C./2 min. |
| (3) Etching | anhydrous chromic acid 400 g/l sulfuric acid 400 g/l | 65° C./5 min. |
| (4) Pickling | 10 vol % $H_2SO_4$ | 25° C./2 min. |
| (5) Predipping | PED-104* 270 g/l | 25° C./2 min. |
| (6) Activating | PED-104* 270 g/l AT-105* 3 vol % | 30° C./10 min. |
| (7) Accelerating | AT-106* 3 vol % | 25° C./5 min. |

*plastic pretreating chemicals commercially available from C. Uyemura Co., Ltd.

The nucleated plate was washed with water and then dipped in the following bath for electroless copper plating to take place for 20 minutes.

| Electroless copper plating bath | |
|---|---|
| Cupric sulfate | 0.024 mol/liter |
| Boric acid | 0.5 mol/liter |
| Phosphorous acid | 0.3 mol/liter |
| Malic acid | 0.052 mol/liter |
| pH | 6.4 |
| Temperature | 45° C. |

The resulting copper deposit was uniform and the deposition efficiency was acceptable.

EXAMPLE 2

The ABS resin plate which had been pretreated in the same manner as in Example 1 was dipped in the same plating bath as in Example 1 together with an anode. Electrolytic copper plating was effected concurrently with electroless copper plating under the following conditions.

| Plating conditions | |
|---|---|
| Time | 15 min. |
| Temperature | 60° C. |
| Agitation | done |
| Anode | platinum plated titanium |
| Cathodic current density | 0.01 → 0.2 A/dm$^2$ (0 → 5 min.) 0.5 A/dm$^2$ (5 → 15 min.) |

The resulting copper deposit was measured for thickness at locations designated A to E in FIG. 1 as well as a location C' which was the rear side of C. The results are shown in Table 1.

TABLE 1

| Deposit thickness (μm) at location | | | | | |
|---|---|---|---|---|---|
| A | B | C | D | E | C' |
| 1.9 | 1.9 | 2.1 | 2.0 | 2.1 | 2.0 |

As is evident from Table 1, the electroless copper plating bath of the present invention is also advantageously applicable to the concurrent electroless and electrolytic copper plating process, forming a uniform copper deposit at acceptable efficiency.

There has been described a low-cost electroless copper plating bath containing a reducing agent in the form of phosphorous acid or a phosphite which is less expensive than hypophosphorous acid used in conventional acidic baths. The bath allows uniform copper deposits to form at reduced cost and equivalent efficiency as compared with the conventional baths. The bath is excellently stable.

While preferred embodiments of the invention have been described, other variations and modifications will become apparent to those skilled in the art. It is intended, therefore, that the invention not be limited to the illustrative embodiments, but be interpreted within the full spirit and scope of the appended claims.

We claim:

1. An electroless copper plating bath comprising in water a water soluble salt of copper a complexing agent, and a reducing agent consisting of a phosphorous acid or a phosphite, said bath having an acidic pH.

2. The bath of claim 1 which contains about 0.02 to abut 0.1 mol/liter of the copper salt, at least about 1 mol of the complexing agent per mol of the copper salt, and about 0.02 to about 0.2 mol/liter of the reducing agent.

3. The bath of claim 1, wherein the pH thereof is 4 to 6.4.

4. The bath of claim 3 which contains about 0.02 to about 0.1 mol/liter of the copper salt, at least about 1 mol of the complexing agent per mol of the copper salt, and about 0.02 to about 0.2 mol/liter of the reducing agent.

* * * * *